US006526702B2

(12) United States Patent
Jones

(10) Patent No.: US 6,526,702 B2
(45) Date of Patent: Mar. 4, 2003

(54) RESIDENTIAL PROGRAM DECK

(76) Inventor: Wesley C. Jones, 725 27th St., Manhattan Bch., CA (US) 90266

( * ) Notice: Subject to any disclaimer, the term of this patent is extended or adjusted under 35 U.S.C. 154(b) by 168 days.

(21) Appl. No.: 09/790,847

(22) Filed: Feb. 21, 2001

(65) Prior Publication Data

US 2002/0112412 A1 Aug. 22, 2002

(51) Int. Cl.[7] ..... E04B 1/346

(52) U.S. Cl. ..... 52/64; 296/26.05; 312/201; 312/198; 188/82.2; 104/295; 104/288

(58) Field of Search ..... 52/36.1, 64, 79.1, 52/238.1, 243.1; 312/198, 199, 200, 201

(56) References Cited

U.S. PATENT DOCUMENTS

| | | | | |
|---|---|---|---|---|
| 2,915,195 A | | 12/1959 | Crosby | 312/201 |
| 3,450,451 A | | 6/1969 | Luman | 312/198 |
| 3,923,354 A | * | 12/1975 | Young | 312/198 |
| 3,944,309 A | | 3/1976 | Taniwaki | 313/198 |
| 4,307,922 A | * | 12/1981 | Rhodes, Jr. | 104/288 |
| 5,069,513 A | * | 12/1991 | Farrell et al. | 104/295 |
| 5,160,189 A | * | 11/1992 | Johnston et al. | 188/82.2 |
| 5,584,546 A | | 12/1996 | Gurin et al. | 312/200 |
| 6,027,190 A | * | 2/2000 | Stewart et al. | 312/201 |
| 6,243,992 B1 | * | 6/2001 | Gyllenhammar | 296/26.05 |

* cited by examiner

*Primary Examiner*—Carl D. Friedman
*Assistant Examiner*—Steve Varner

(57) ABSTRACT

A plurality of wheeled cabinets, including single-sided cabinets (20) and double-sided cabinets (21), is movably mounted upon fixed rail assemblies (90) and (90A). Each cabinet is fitted with an extendable privacy partition (80), an automatically deployed safety-spacer assembly (110), and is capable of accepting both factory-finished and custom-fabricated furniture and fixture infill packages (24) that provide the activity spaces (23) created in between the cabinets with all of the appurtenances necessary to particularize these spaces into functionally specific rooms. A continuous conductor rail (100) supplies power, telephone, and data to the residential program deck.

20 Claims, 14 Drawing Sheets

RESIDENTIAL PROGRAM DECK

CROSS-REFERENCE TO RELATED APPLICATIONS

Not applicable.

BACKGROUND—Field of Invention

This invention relates to houses, storage systems, and residential space-divisions, specifically to an improved means for dividing a house into flexibly re-sizable particularized activity spaces.

BACKGROUND—Description of Prior Art

Dwelling requires space. There is, however, a limited amount of space available to accommodate an increasing number of individuals. Space is therefore a valuable commodity not to be wasted.

Currently only a small percentage of the typical house is used/occupied at any given time. Typically there are more rooms than occupants, and rarely is each occupant occupying a separate room at any given time. It is therefore advantageous to reduce or eliminate wasted domestic space by maximizing the amount of floor space devoted to the activity at hand while minimizing the amount of space devoted to activities which are not taking place (empty rooms). It will also be beneficial to provide a means for new, additional types of activity spaces to be introduced into the home without increasing the size of the house or without compromising the amount of space devoted to any particular activity.

Past efforts at applying space-saving strategies to the home have concentrated primarily on the efficient storage of inert property or the combining of multiple activities into a single space. Thus they have typically targeted their innovations on closets, cabinet spaces, and the like, or on murphy beds, trundle beds, and built-in ironing boards.

The problem with these aforementioned innovations is that they fail to maximize the amount of available space devoted to a particular activity by minimizing or eliminating unused or unoccupied space elsewhere in the house, so that the highlighted activity is spatially compromised. Another problem with the aforementioned innovations is that they fail to reduce the overall footprint of the house.

There exist however certain movable high-density storage shelf systems which address this problem in institutional or commercial environments. Such storage systems are typically comprised of a plurality of wheeled storage shelves or cabinets, movably mounted upon rails so as to permit adjacent shelf units to be moved into and out of abutting engagement with one another in order to eliminate or create an access aisle therebetween. These storage systems offer a fixed, limited amount of usable space that can be transferred from location to location as required for access to the constituent cabinets of the system.

Several such storage systems have been disclosed—for example, U.S. Pat. No. 2,915,195 (1959) to Crosby, U.S. Pat. No. 3,923,354 (1975) to Young, and U.S. Pat. No. 3,944,309 (1976) to Taniwaki. Storage shelves of this type are never used in domestic applications but rather are typically employed in libraries and offices for the efficient storage of papers, books, and like articles. As such they exhibit various disadvantages relative to their use in the domestic environment in order to divide a house into flexibly re-sizable particularized activity spaces:

(a) These storage units fail to describe an integral means for enclosing the open sides of the space created between any two such cabinets in order to make an isolated, private space.

(b) These storage units fail to demonstrate a means for accommodating within them multiple different types of furniture configurations to support a variety of residential activities.

(c) These units fail to allow for the easy redecoration of their side panels.

(d) The chassis of these storage units do not allow for an inset area to accommodate the feet of a seated individual in such a way as to permit the comfortable use of an inscribed desk surface or the like.

(e) The safety-spacers disclosed in the prior art are not deployed automatically and, when deployed, obstruct access to and from the aisles that they maintain.

(f) These storage systems are incapable of preserving multiple open access aisles while being moved.

(g) These storage systems make no provision for providing electric power supply to the cabinets.

(h) These storage systems make no provision for providing telephone and data connections to the cabinets.

U.S. Pat. No. 3,450,451 (1969) to Lyman discloses a type of portable, multiple-use cabinet intended for "open" type schools as a space divider capable also of acting as a teaching station, a book storage area, a general storage area, or a wardrobe. In addition to the aforementioned disadvantages, this invention also suffers from its use of casters as a means to movably relocate said cabinets, which are not well suited to the controlled moving of units back and forth along a straight line to spontaneously and easily create and eliminate activity spaces therebetween. Moreover, it describes a fixed range of infill components that allow for a limited number of possible configurations and types of performance for these cabinets.

U.S. Pat. No. 5,584,546 (1996) to Gurin et al. discloses an isolated transportable, caster-mounted office workstation. While describing a means for integral power and telephone to be supplied to this workstation, it is otherwise highly specific in terms of its proposed use and describes no means for being used in combination with other such cabinets to divide a house into flexibly re-sizable particularized activity spaces in lieu of conventional, fixed rooms. In addition, Gurin's pre-wired cabinet requires "external connectors for phone and power hookups" that would require loose power and phone cords to be run to the cabinet if such a cabinet were moved away from an adjacent wall, which would present a dangerous tripping hazard and an unsightly appearance. As such, Gurin's workstation does not describe a cabinet that could be used in sequence with other such cabinets in order to create flexibly re-sizeable domestic activity spaces.

U.S. Pat. No. 3,944,309 (1976) to Taniwaki discloses a "manually positioned safety device" for a "movable wheeled storage rack" that requires its user to consciously deploy this safety device subsequent to entering an access aisle between two units of the storage rack described. As such, it is ineffectual unless the user sees this device and knows to deploy it. Furthermore, it is ineffectual if the user is aware of this device but neglects to deploy it. Also, while deployed it presents an obstruction that prevents access to and from the access aisle that it is maintaining if the access aisle is narrow, or, if the access aisle is large enough for additional users to bypass this safety device, it nevertheless presents a dangerous projection into the useful space of the storage rack. Lastly, the safety device described by Taniwaki is mounted on only one side of the storage racks of his invention and, due to this eccentric position, it is not easily used to push against the adjacent storage rack and thus allow a minimum access aisle to be maintained while the racks are being moved.

SUMMARY

In accordance with the present invention a residential program "deck" comprises a plurality of wheeled cabinets movably mounted upon fixed rails, each such cabinet individually supplied with a deployable privacy partition, integral access to electric power, telephone, and data, an automatically deployed safety-spacer, and capable of accepting both factory-finished and custom-fabricated furniture and fixtures packaged and arranged so as to be mounted thereto in order to provide all of the appurtenances necessary to particularize these spaces into functionally specific rooms.

Objects and Advantages

Several objects and advantages of this invention are:

(a) to provide a residential program deck with an integral means for enclosing the open sides of the space created between any two of its constituent cabinets in order to render said space visually and aurally isolated from adjacent spaces;

(b) to provide a residential program deck that can accommodate multiple different types of furniture and fixture infill packages to support a variety of residential activities in lieu of the static, functionally-specific rooms contained in the conventional house;

(c) to provide a residential program deck in which the side panels of the constituent cabinets can be easily redecorated;

(d) to provide a residential program deck in which each constituent cabinet has a chassis with an inset area capable of accommodating the feet of a seated individual facing said cabinet, thus allowing said cabinet to contain an inscribed desk or table surface which can be comfortably used;

(e) to provide a residential program deck in which each constituent cabinet has a safety-spacer that is deployed automatically to prevent users from being inadvertently crushed between two such cabinets without requiring the users to first consciously lock the units, and which, when deployed, does not present an obstruction or hazardous projection;

(f) to provide a residential program deck in which multiple open access aisles may be preserved while the cabinets of the deck are being moved;

(g) to provide a residential program deck in which each constituent cabinet is supplied with access to electric power in order to support common household electrical appliances;

(h) to provide a residential program deck with cabinets capable of supporting telephone and data connections.

Further objects and advantages of the present invention are to provide a residential program deck with constituent fixed end cabinets capable of accommodating all residential furniture and fixtures (including such fixtures as toilets, sinks, bathtubs, showers, and dishwashers that require hot and cold water supply and the evacuation of waste water) within discrete, easy-to-operate cabinets that allow activity spaces to be easily and spontaneously created therebetween as a space-saving alternative to multiple permanent rooms, that minimizes the amount of wasted space in the house by allowing all available space to be assigned to the specific activity-spaces being used at any given moment, and that allows its constituent cabinets to be easily added to, subtracted from, modified, or exchanged without the need for costly renovation or remodeling. Still further objects and advantages will become apparent from a consideration of the ensuing description and drawings.

DRAWING FIGURES

In the drawings, closely related figures have the same number but different alphabetic suffixes.

DESCRIPTION OF THE PREFERRED EMBODIMENT

Figure 1:
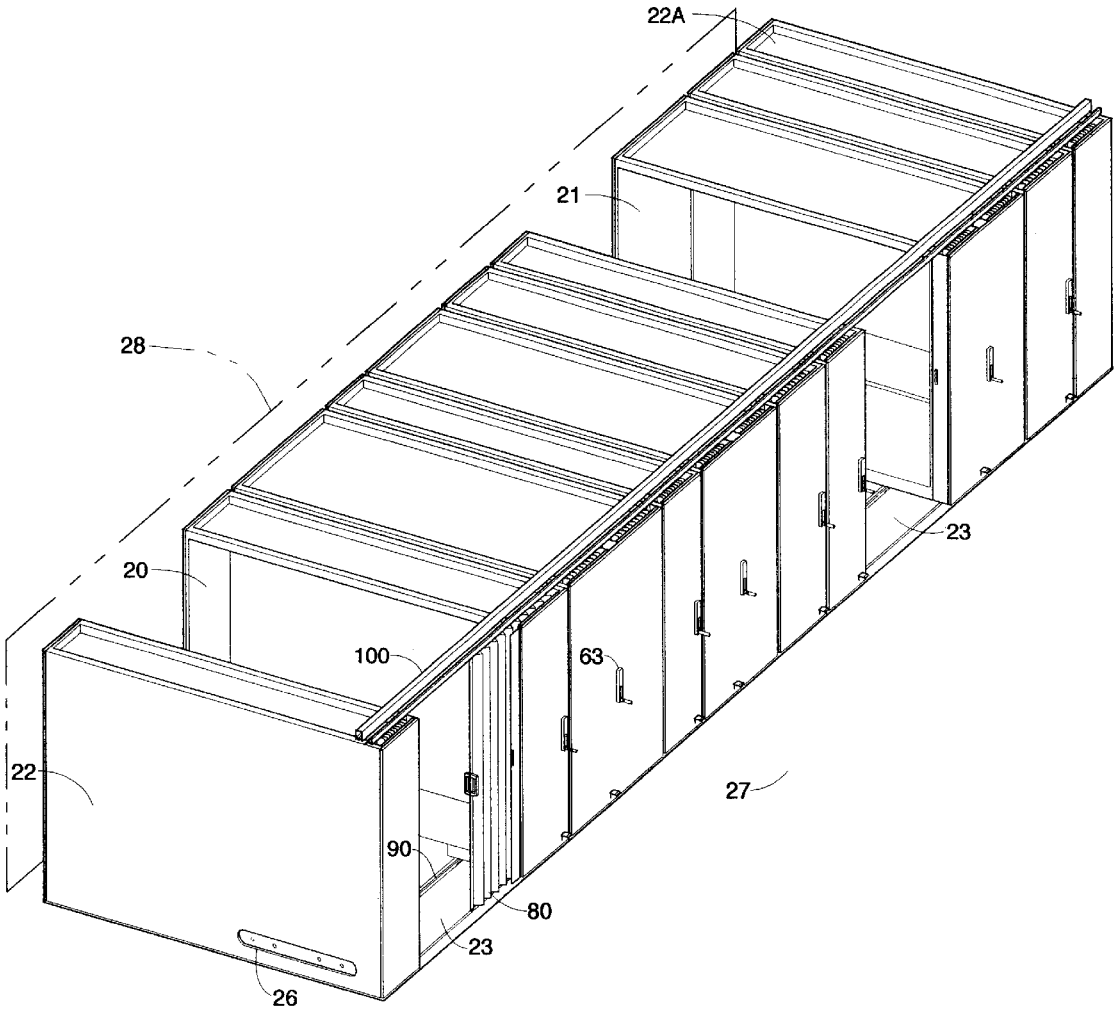
FIG. 1 shows an embodiment of the proposed residential program deck, including single-sided and double-sided cabinets.

A preferred embodiment of the present invention is illustrated in FIG. 1. The residential program deck is comprised of a plurality of movably mounted elongated cabinets, including both single-sided cabinets 20 and double-sided cabinets 21, which are arrayed in sequence between two fixedly mounted end cabinets 22 and 22A and along a continuous wall 28. All cabinets except for the fixedly mounted end cabinets 22 and 22A are movably mounted to a pair of parallel elongated rail assemblies (or similar parallel linear guiding members) 90 and 90A so as to permit adjacent cabinets to be moved into and out of abutting engagement with one another by means of a force-applying drive means (or similar driving means) 63 in such a way as to eliminate or create an activity space 23 between any two such adjacent cabinets. An extendable privacy partition 80 is stored within a privacy partition stowage area 84 (shown in FIGS. 2 and 4) of each cabinet, and can be deployed between any two cabinets in order to visually and aurally separate any activity space 23 from an adjacent continuous public access space 27. A wet-service hookup area 26, including wet-service attachment means for conventional residential hot and cold water, drainage, and sewage, is provided at the back side of each fixedly mounted end cabinet 22 and 22A so as to allow each to contain such fixtures or devices as bathtubs, showers, sinks, dishwashers, toilets, and the like.

The remaining residential program not requiring such wet-service hookups 26 is contained within various off-the-shelf or custom-fabricated infill packages 24, as indicated schematically in FIGS. 2 to 5. The specific nature of these various infill packages 24 is not pertinent to the present invention, which is instead concerned with the overall system and its generic components.

Referring further to FIGS. 2 to 5, a single-sided cabinet 20 (FIGS. 2 and 3) and a double-sided cabinet 21 (FIGS. 4 and 5) are shown in more detail. A chassis 30 of each cabinet is composed of longitudinal perimeter base beams 31, 31A, and 31B and transverse perimeter base beams 32 and 32A, upon which are affixed corner posts 35, 35A, 35B, and 35C at the corners, on top of which are mounted longitudinal perimeter header beams 33 and 33A and transverse perimeter header beams 34 and 34A. Spanning transversely between the longitudinal perimeter base beams 31 and 31A (and between longitudinal perimeter base beams 31 and 31B) are two pairs of two transverse joists 36 and 36A, and 36B and 36C.

Figure 3:
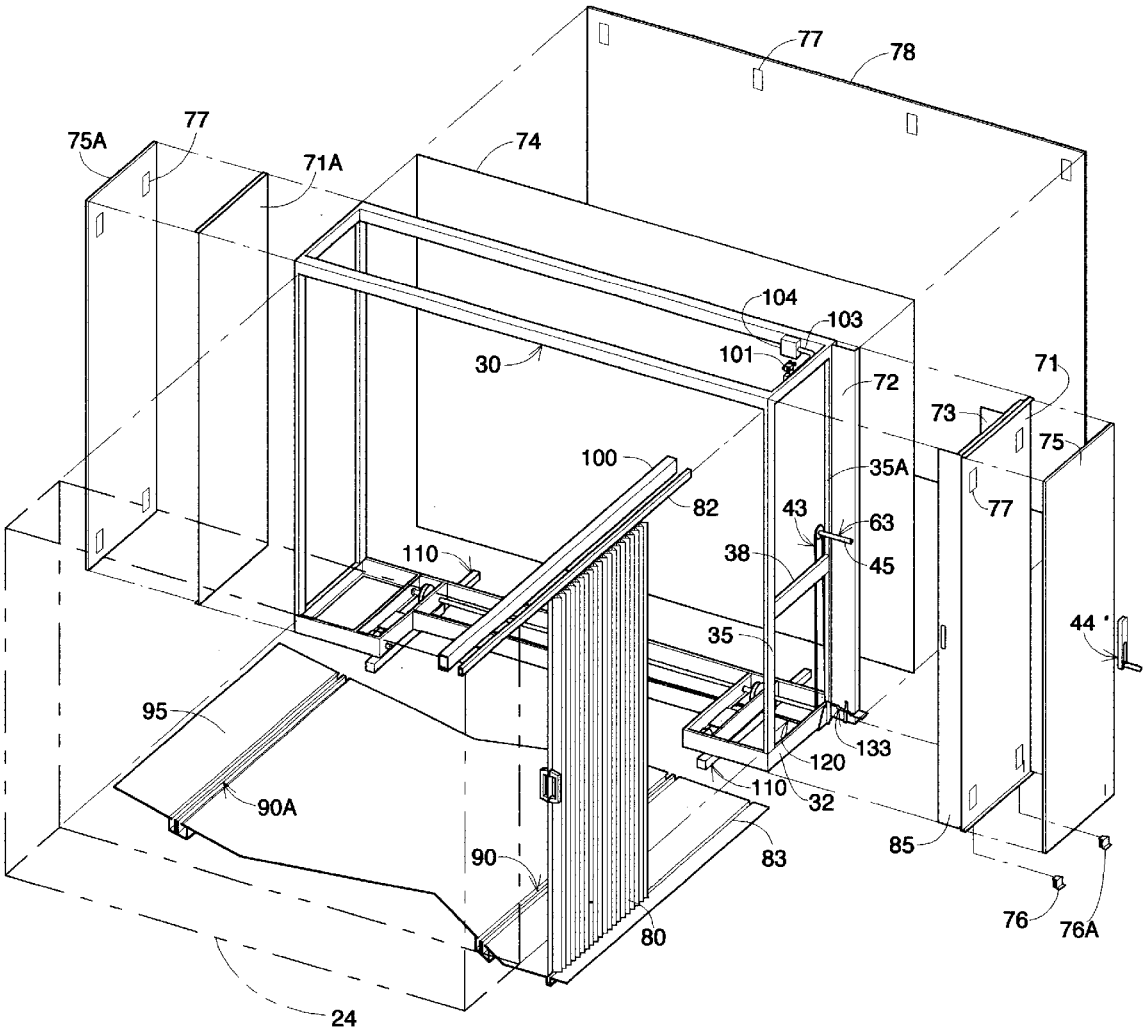
FIG. 3 shows an exploded view of this single-sided cabinet.
Figure 4:
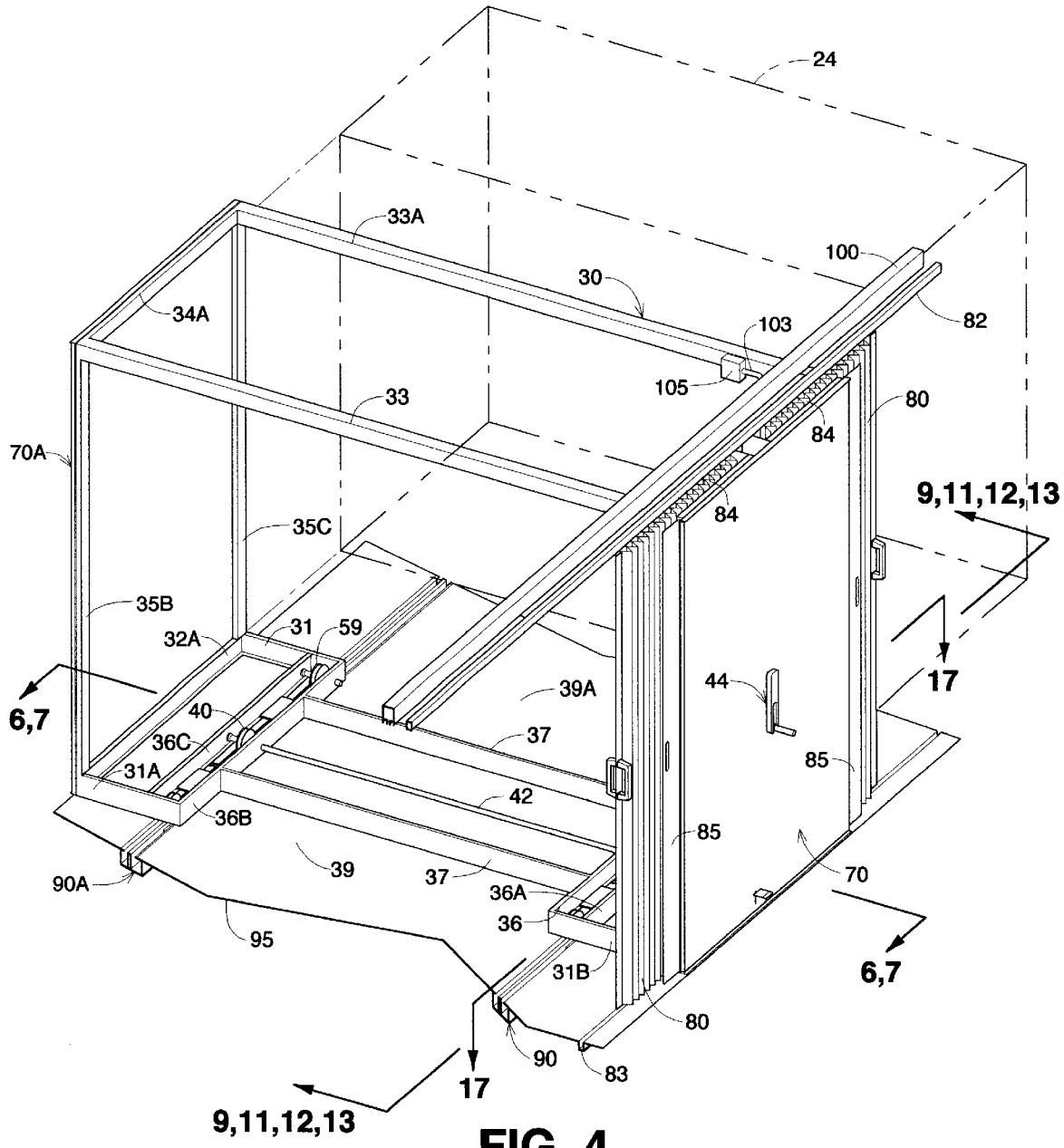
FIG. 4 shows a constituent double-sided cabinet.
Figure 5:
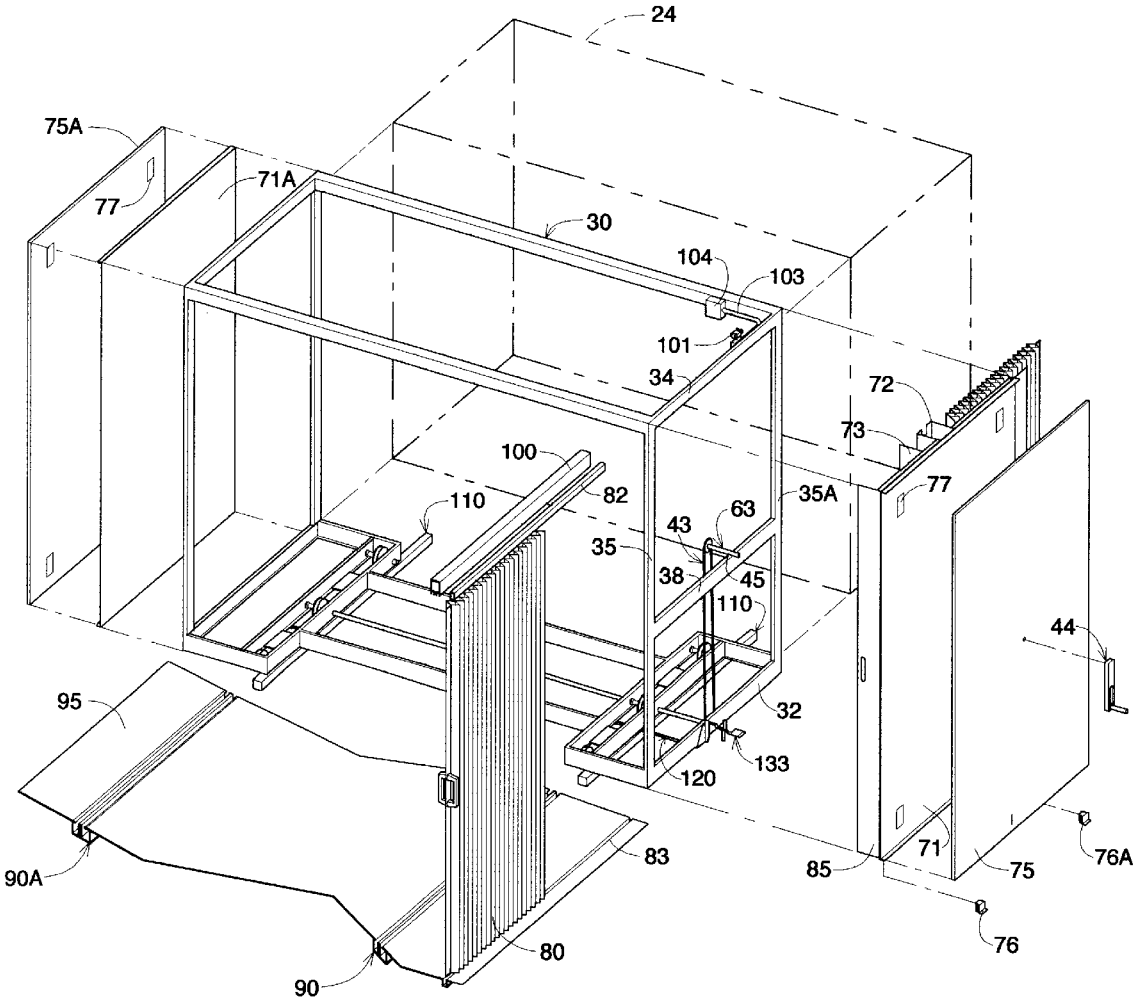
FIG. 5 shows an exploded view of this double-sided cabinet.

An inset area 39 is made on the front side of single-sided cabinet 20 (FIGS. 2 and 3) and on both the front and back sides of double-sided cabinet 21 (for inset area 39 and inset area 39A on double-sided cabinet 21 see FIGS. 4 and 5) by the location inboard of the line established by the longitudinal perimeter base beams of a longitudinal joist 37 spanning between innermost transverse joists 36 and 36B. An intermediate beam 38 (shown in FIGS. 3 and 5) is located between two corner posts 35 and 35A which define the side of the chassis 30 that faces public access space 27 (shown in FIG. 1). A rotatable handle shaft 45 passes through this intermediate beam 38 and through a handle shaft collar 46 in side panel assembly 70 and connects a rotatable handle assembly 44 (shown in more detail in FIGS. 14A to 14C) to a drive chain and gear assembly 43 (shown in FIGS. 3 and 5), which together comprise a force-applying drive means (or driving means) 63.

Figure 14A:
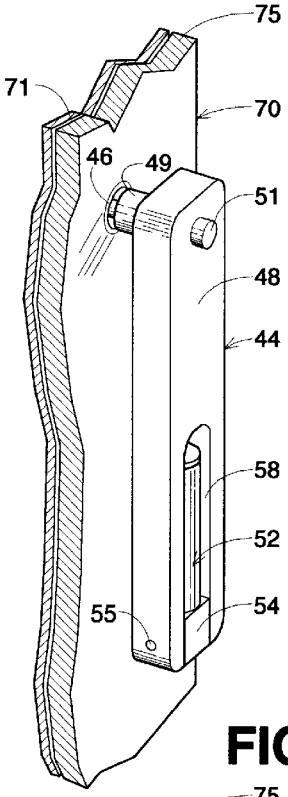
FIG. 14A shows the handle assembly with the handle arm pulled out and with the handgrip stowed.
Figure 14B:
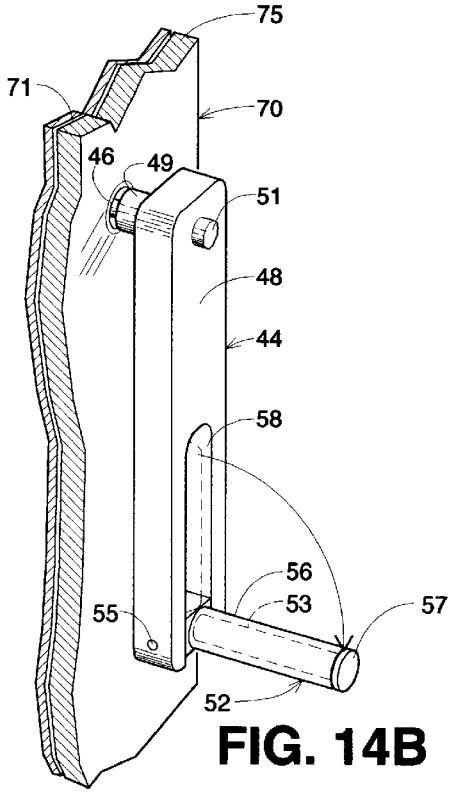
FIG. 14B shows the handle assembly with the handle arm pulled out and with the handgrip rotated out.
Figure 14C:
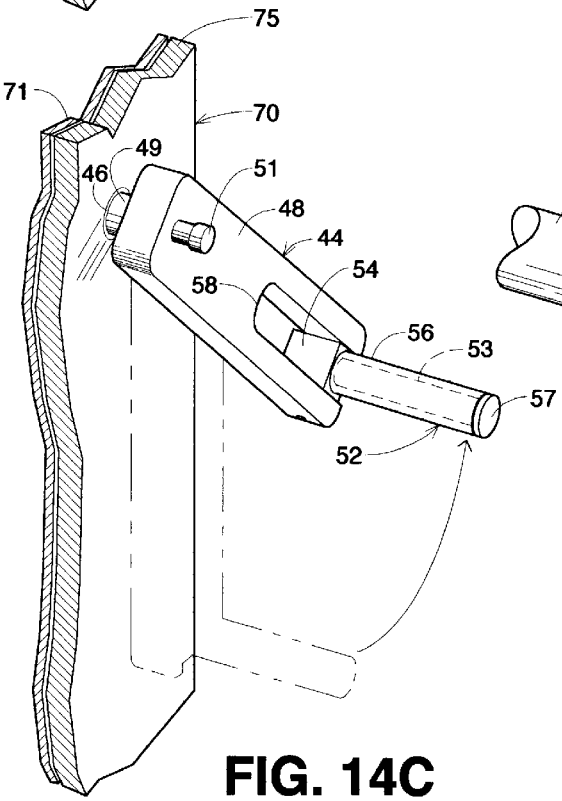
FIG. 14C shows the handle assembly with the handle arm pushed in and with the handgrip rotated out.
Figure 14D:
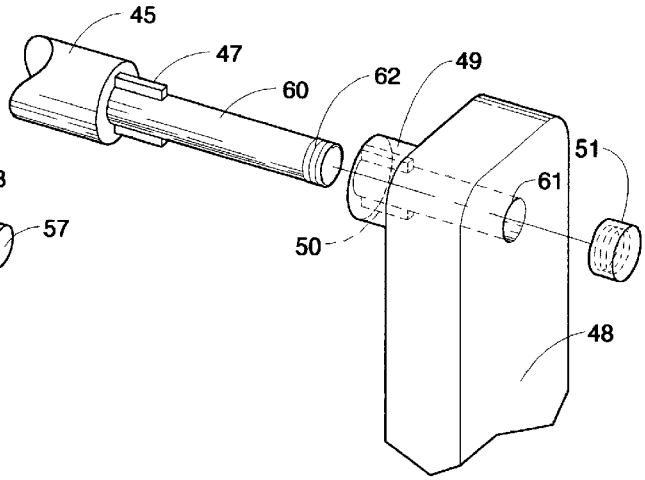
FIG. 14D shows an exploded view of the handle assembly.
Figure 15A:
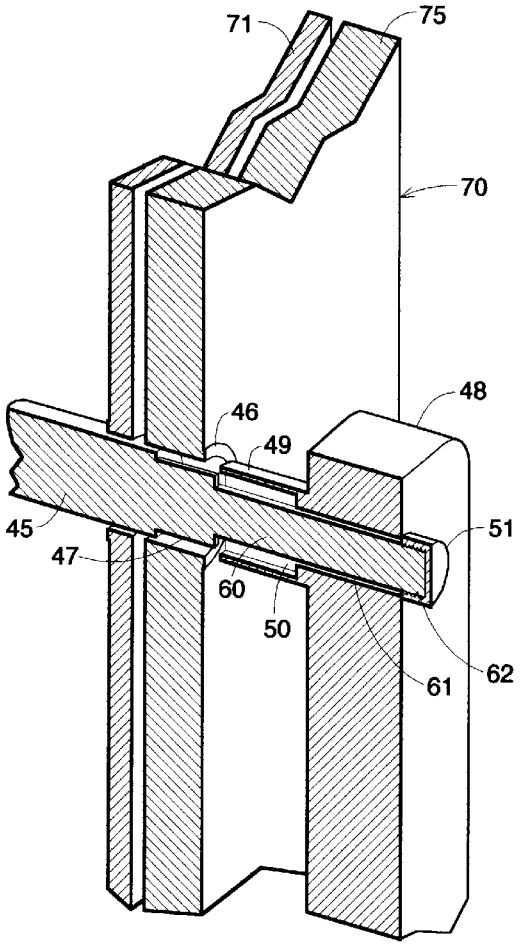
FIG. 15A shows a sectional view through the handle and handle shaft with the handle disengaged from the handle shaft.
Figure 15B:
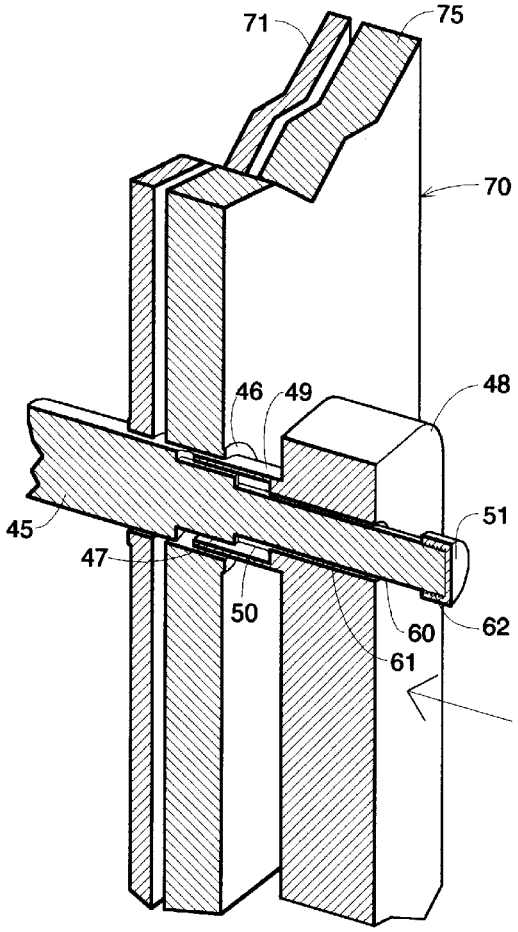
FIG. 15B shows a sectional view through the handle and handle shaft with the handle engaged in the handle shaft.

Referring to FIGS. 14A through 14D, a rotatable handle arm 48 is affixed loosely to a handle shaft extension 60 such that it may be rotated about handle shaft extension 60 and also moved in and out along the axis of the handle shaft extension. A handle arm sleeve 49 is formed as part of rotatable handle arm 48 on axis with handle shaft extension 60. Handle shaft extension 60 (shown most clearly in FIG. 14D) penetrates handle arm sleeve 49 and rotatable handle arm 48 through a hole 61. A threaded end 62 of handle shaft extension 60 protrudes from hole 61 and receives a threaded end cap 51, which prevents rotatable handle arm 48 from slipping off of handle shaft extension 60. Referring specifically to FIGS. 14D, 15A, and 15B an elongated salient projection 47 extends from rotatable handle shaft 45 along a length of handle shaft extension 60. A recessed socket 50 in handle arm sleeve 49 may be fitted over elongated salient projection 47 when rotatable handle arm 48 is pushed toward the cabinet along handle shaft extension 60, thus allowing a rotary motion of rotatable handle arm 48 to be transferred to rotatable handle shaft 45 and drive chain and gear assembly 43 (which is shown in FIGS. 3 and 5).

A handle grip assembly 52 (shown in FIGS. 14A to 14C) is comprised of a cylindrical handle grip shaft 53 attached to a handle grip base 54. A hollow cylindrical handle grip sleeve 56 is fitted over handle grip shaft 53 such that it is allowed to rotate independently of handle grip shaft 53. A handle grip end cap 57 of the same or larger diameter than handle grip sleeve 56 is affixed to the end of handle grip shaft 53 in order to prevent handle grip sleeve 56 from slipping off of handle grip shaft 53. Handle grip base 54 is affixed within a handle grip recess 58 by means of a handle grip base pin 55, which allows handle grip assembly 52 to be rotated into and out of handle grip recess 58 as shown in FIGS. 14A and 14B. (In an alternative embodiment, rotatable handle arm 48 and handle grip assembly 52 may be replaced by a rotatable wheel affixed to handle arm sleeve 49).

Referring again to FIGS. 2 to 5, drive chain and gear assembly 43 (which is comprised of a gear or other rotatable member attached to rotatable handle shaft 45 and connected by a continuous chain to another gear or similar rotatable drive means) is affixed to drive shaft or axle 42, which passes through two drive wheels 40, one centered between transverse joists 36 and 36A and one centered between transverse joists 36B and 36C. The axis of drive shaft 42 and of drive wheels 40 is located toward the rear longitudinal side of single-sided cabinet 20 (FIGS. 2 and 3) and in the longitudinal center of double-sided cabinet 21 (FIGS. 4 and 5). In the case of single-sided cabinet 20 (FIGS. 2 and 3), two additional passive wheels 59 are centered between each pair of transverse joists (between transverse joists 36 and 36A and between transverse joists 36B and 36C) along independent axles 41 which together define an axis along the front longitudinal side of the cabinet. In the case of double-sided cabinet 21 (FIGS. 4 and 5), two pairs of two additional passive wheels 59 are centered between each pair of transverse joists 36 (between transverse joists 36 and 36A and between transverse joists 36B and 36C) along independent axles 41 which together define a pair of axes, one along the front longitudinal side of the cabinet and one along the rear longitudinal side of the cabinet. This pair of axes is centered about the axis of drive shaft 42 and of drive wheels 40.

Figure 16:
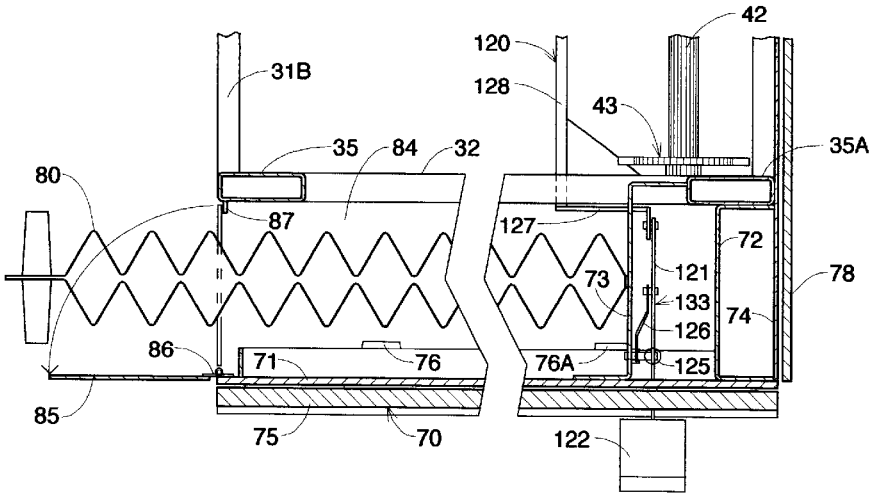
FIG. 16 shows a plan section through the side panel assembly of a single-sided cabinet.
Figure 17:
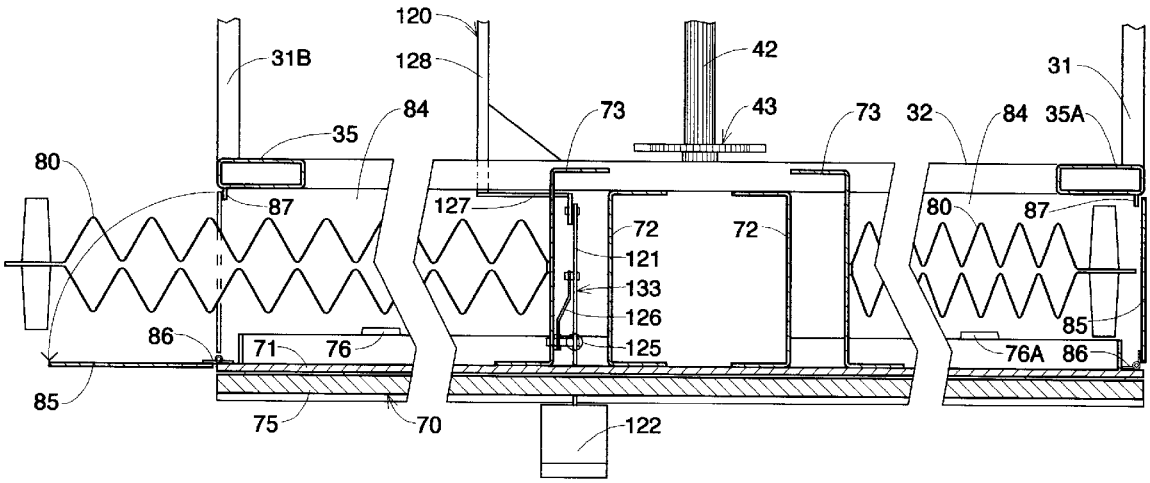
FIG. 17 shows a plan section through the side panel assembly of a double-sided cabinet.

Referring further to FIGS. 2 to 5, a first side panel assembly 70 is held off of chassis 30 on the side of the cabinet that faces public access space 27 (shown in FIG. 1) by both a primary side enclosure support 72 and a secondary side enclosure support 73 (which are shown also in more detail in FIGS. 16 and 17). Side panel assembly 70 is comprised of a steel side enclosure 71 to which is affixed a removable decorative side panel 75 by means of non-permanent fasteners 77, such as hook-and-loop fasteners, snap fasteners, or the like. As first side panel assembly 70 is located on the same side of the cabinet as rotatable handle assembly 44 and safety-spacer release assembly 120, its constituent steel side enclosure 71 and removable decorative side panel 75 are formed with the appropriate apertures to allow these assemblies to penetrate them (shown in more detail in FIGS. 6, 7, 15A, and 15B). A second side panel assembly 70A, which in this preferred embodiment does not require the aforementioned apertures, is affixed directly to chassis 30 on the opposite side of the cabinet from the first side panel assembly 70. A steel back enclosure 74 is affixed to the rear longitudinal side of chassis 30 of single-sided cabinet 20, to which is affixed a removable decorative back panel 78 by means of non-permanent fasteners 77.

Figure 2:
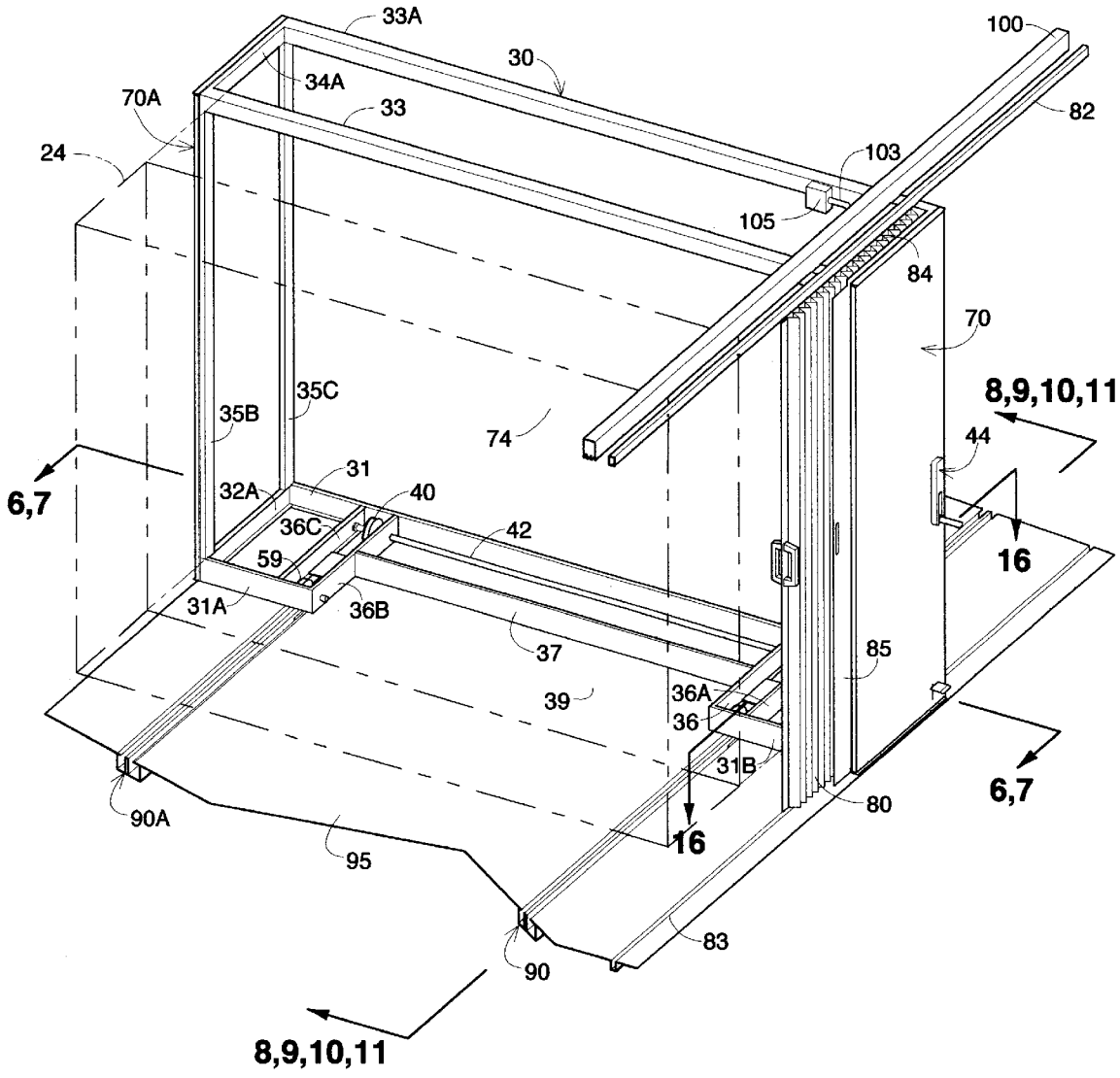
FIG. 2 shows a constituent single-sided cabinet.
Figure 6:
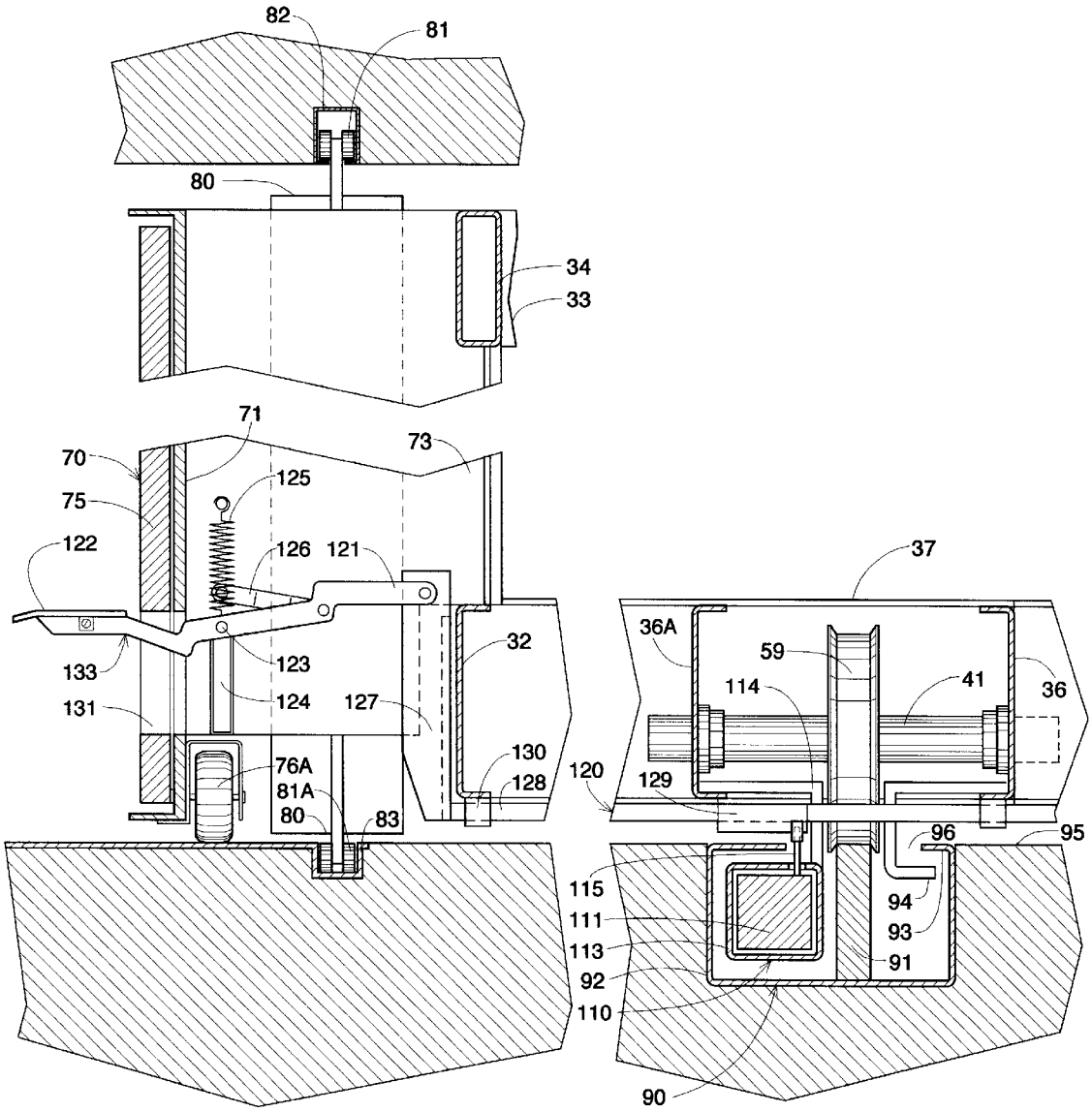
FIG. 6 shows a longitudinal section through a cabinet with the safety-spacer mechanism engaged.
Figure 7:
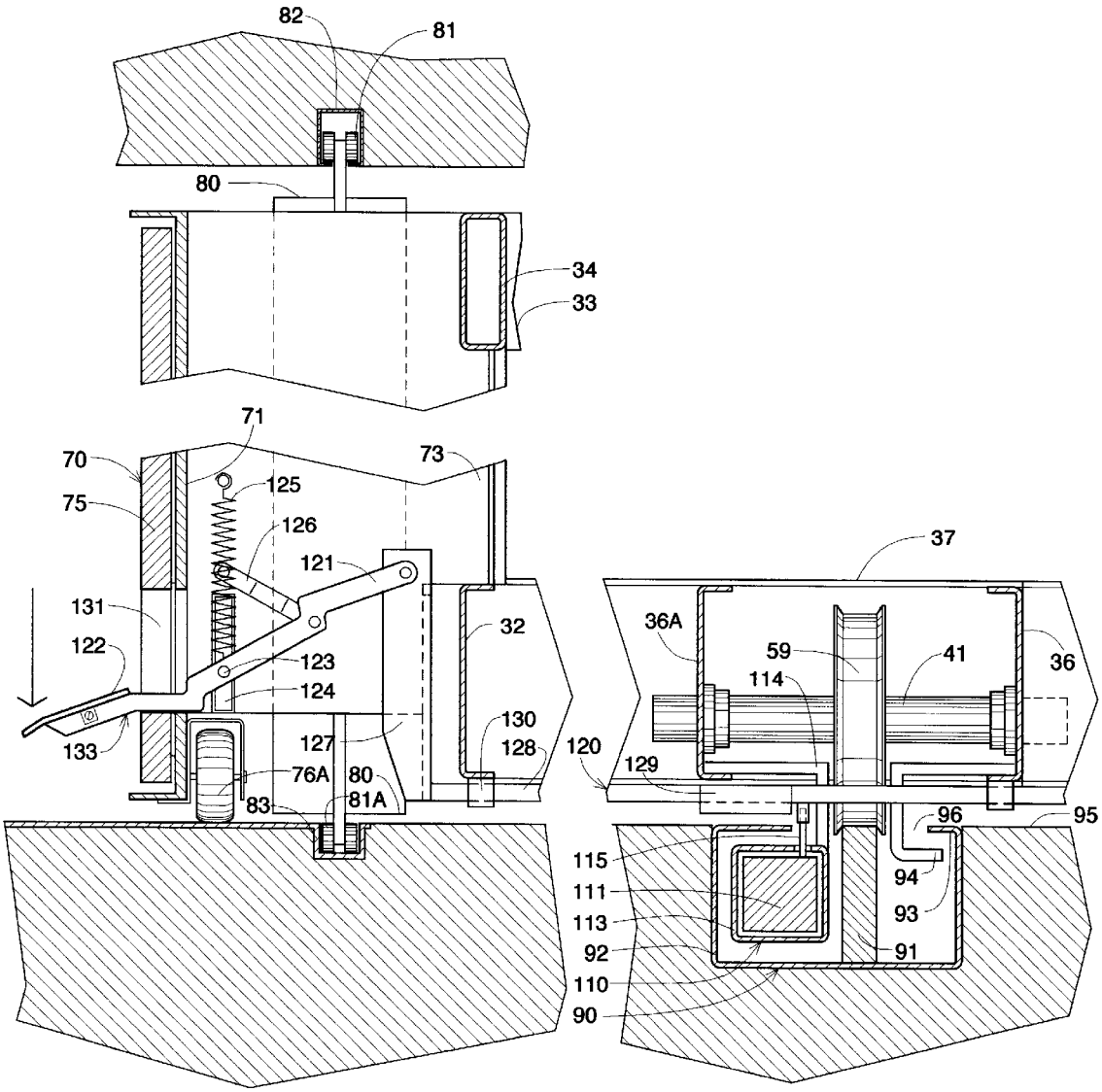
FIG. 7 shows a longitudinal section through a cabinet with the safety-spacer mechanism disengaged.

First side panel assembly 70 on the side of the cabinet that faces public access space 27 (shown in FIG. 1) and that is held off of chassis 30 by means of both primary side enclosure support 72 and secondary side enclosure support 73 is given additional support by a pair of concealed-mount casters 76 and 76A (shown in greater detail in FIGS. 6 and 7). Referring to FIGS. 16 and 17, an extendable privacy partition 80 that can be compressed or extended as required to cover various sized openings is affixed at one end to secondary side enclosure support 73 and stored within a privacy partition stowage area 84. A stowage area door 85 is affixed by means of a hinge 86 that is attached to side panel assembly 70, by which means stowage area door 85 may be opened to allow extendable privacy partition 80 to be extended out from the cabinet and attached to an adjacent cabinet with a suitable attachment means (not shown), thereby enclosing an area between two adjacent cabinets. FIGS. 2 and 3 show that single-sided sided cabinet 20 has one such extendable privacy partition 80, privacy partition stowage area 84, and stowage area door 85, while FIGS. 4 and 5 show that double-sided cabinet 21 has two of each, arranged opposite to one another.

Extendable privacy partition 80 is fitted with privacy partition guide wheels 81 on its top and privacy partition guide wheels 81A on its bottom. An upper privacy partition guide track 82, set into the finished ceiling, and a lower privacy partition guide track 83, set into finished floor 95 (visible in more detail in FIGS. 6 and 7), are located in the plane of extendable privacy partition 80 and run in the direction of travel of the cabinets along the entire length of the residential program deck. Privacy partition guide wheels 81 run within upper privacy partition guide track 82 and privacy partition guide wheels 81A run within lower privacy partition guide track 83 (shown in FIGS. 6 and 7), allowing extendable privacy partitions 80 associated with each cabinet to be deployed regardless of the locations of the cabinets.

Continuing to refer to FIGS. 2 to 5, a conductor rail 100 (or other continuous linear electrical supply means), set into the finished ceiling, runs parallel to upper privacy partition guide track 82 along the entire length of the residential program deck in order to provide a means to supply electrical power, telephone, and data to each of the cabinets. At the top of each cabinet, a conductor head 101 (or similar conduction means) is affixed to transverse perimeter header beam 34. A flexible conduit 103 extending from conductor head 101 supplies electricity, telephone, and data to a junction box 104, from which electrical/telephone/data connections can be supplied to the infill package 24 as required.

Two continuous parallel linear guiding members (or elongated rail assemblies) 90 and 90A, set into finished floor 95, run the entire length of the residential program deck between fixedly mounted end cabinets 22 and 22A (shown in FIG. 1). Referring to FIGS. 6 and 7 it can be seen that each rail assembly 90 and 90A is comprised of an elongated rail enclosure (or elongated linear enclosure) 92 (which includes a continuous slot 96 let into the uppermost surface) and into which is affixed a rail 91 (which could also be formed as a part of elongated rail enclosure 92). A three-sided anti-tip member 94 is affixed to transverse joist 36 and positioned in interlocking proximal relation to a lip 93 of elongated rail enclosure 92, such that if the cabinet were subjected to an uplifting or overturning force three-sided anti-tip member 94 would engage lip 93 of elongated rail enclosure 92, thereby preventing the cabinet from derailing.

Figure 8:
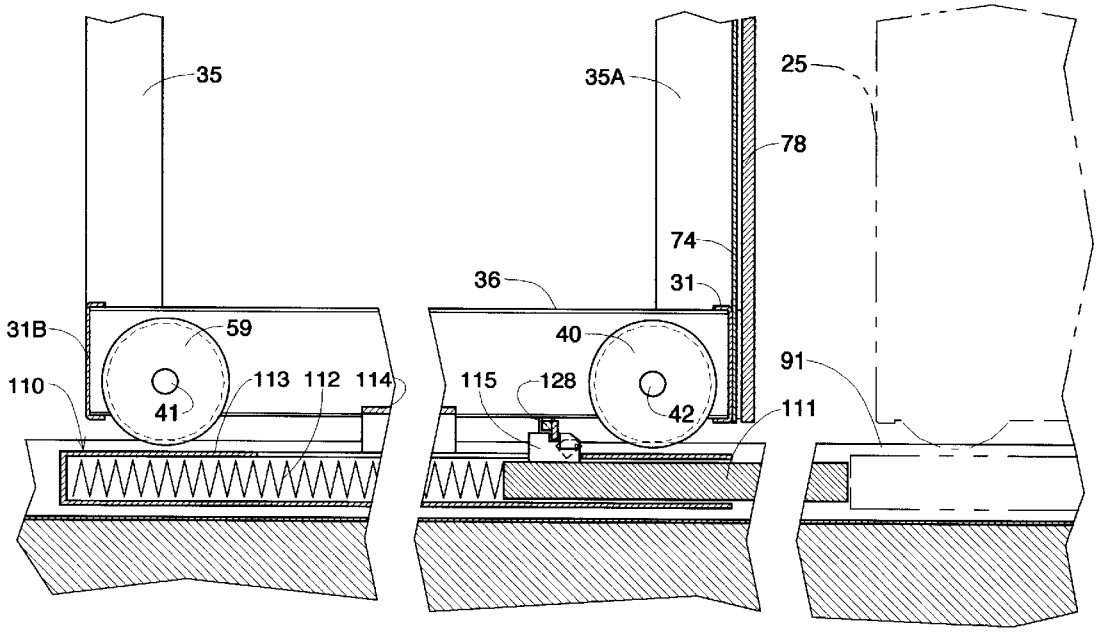
FIG. 8 shows a transverse section through a single-sided cabinet with the safety-spacer mechanism engaged.
Figure 9:
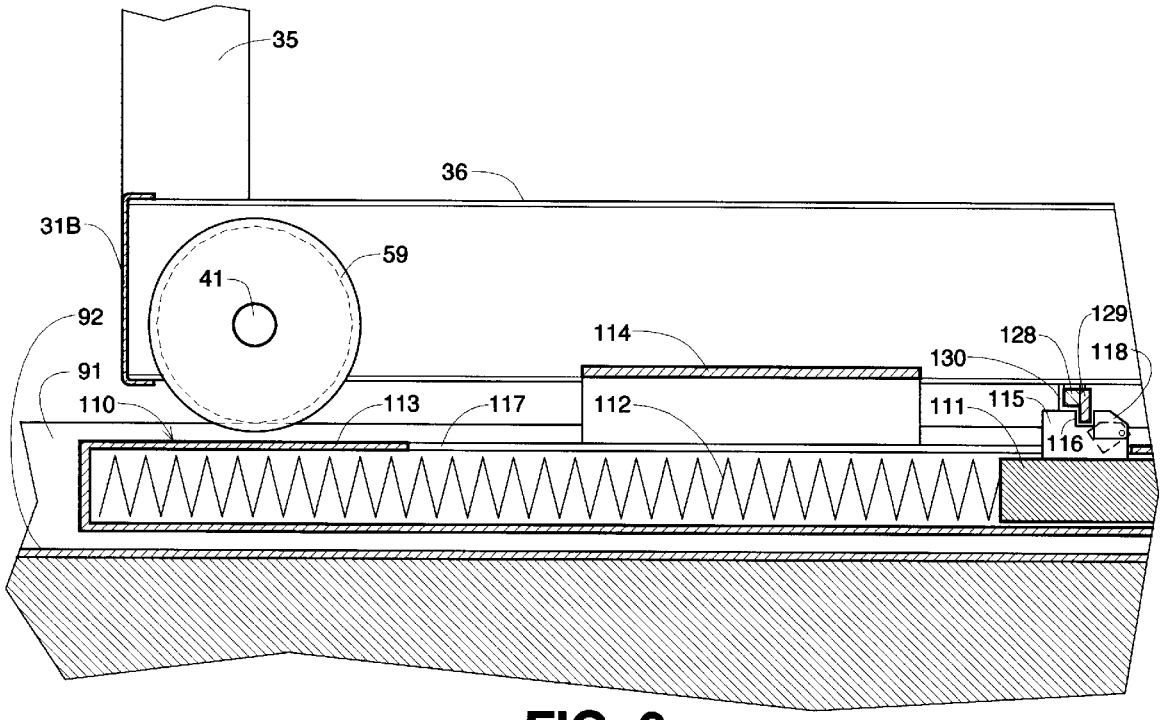
FIG. 9 shows a detail transverse section through the engaged safety-spacer mechanism (for both single-sided and double-sided cabinets).
Figure 11:
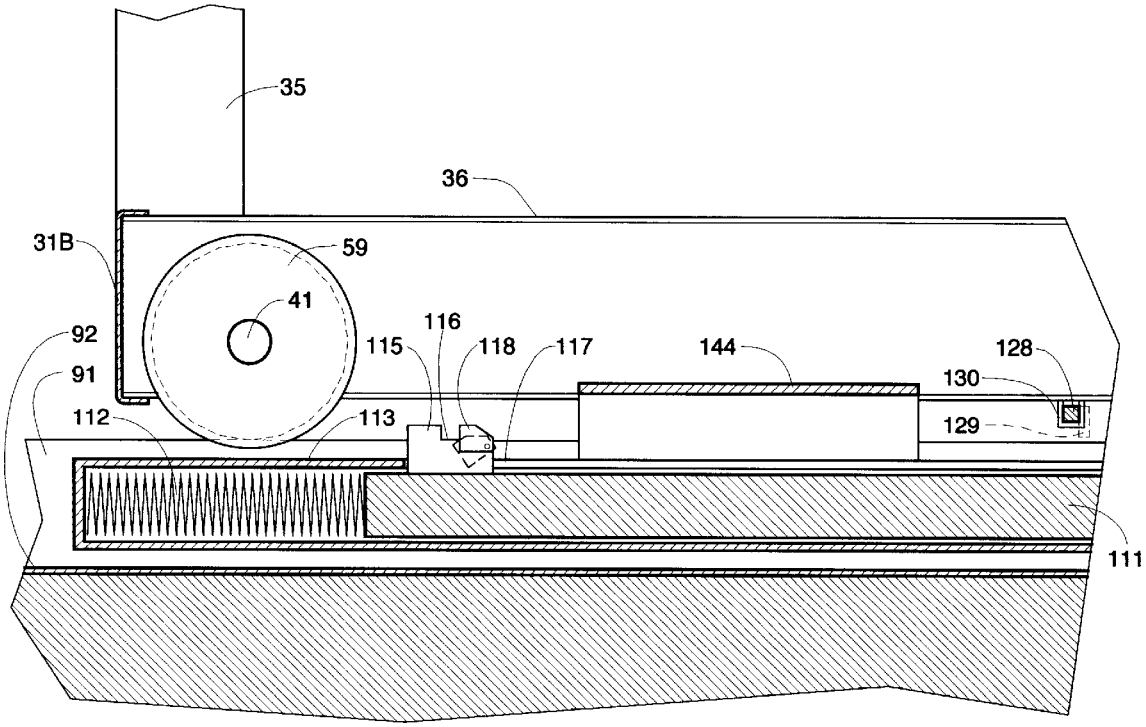
FIG. 11 shows a detail transverse section through the disengaged safety-spacer mechanism (for both single-sided and double-sided cabinets).
Figure 12:
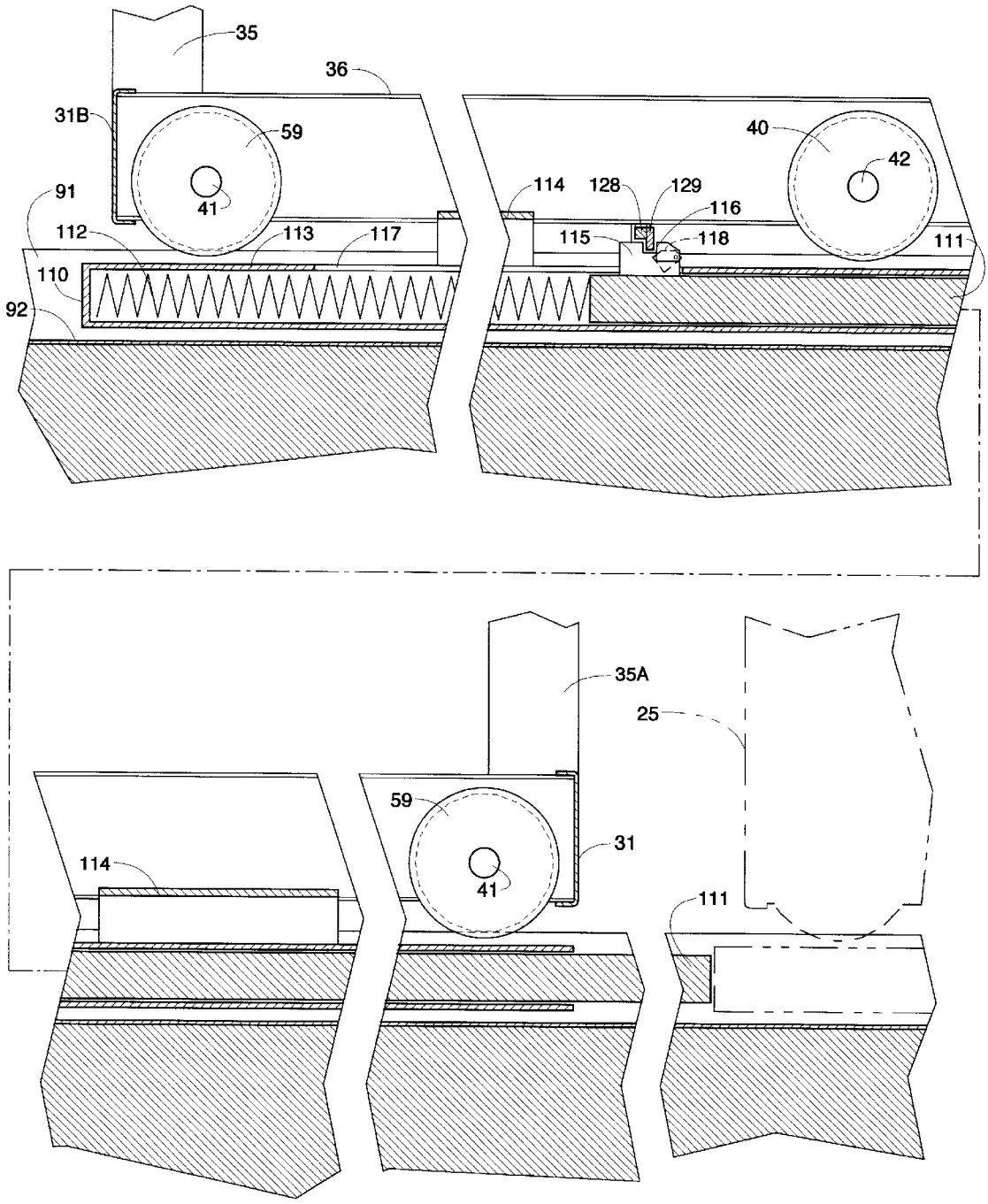
FIG. 12 shows a transverse section through a double-sided cabinet with the safety-spacer mechanism engaged.
Figure 13:
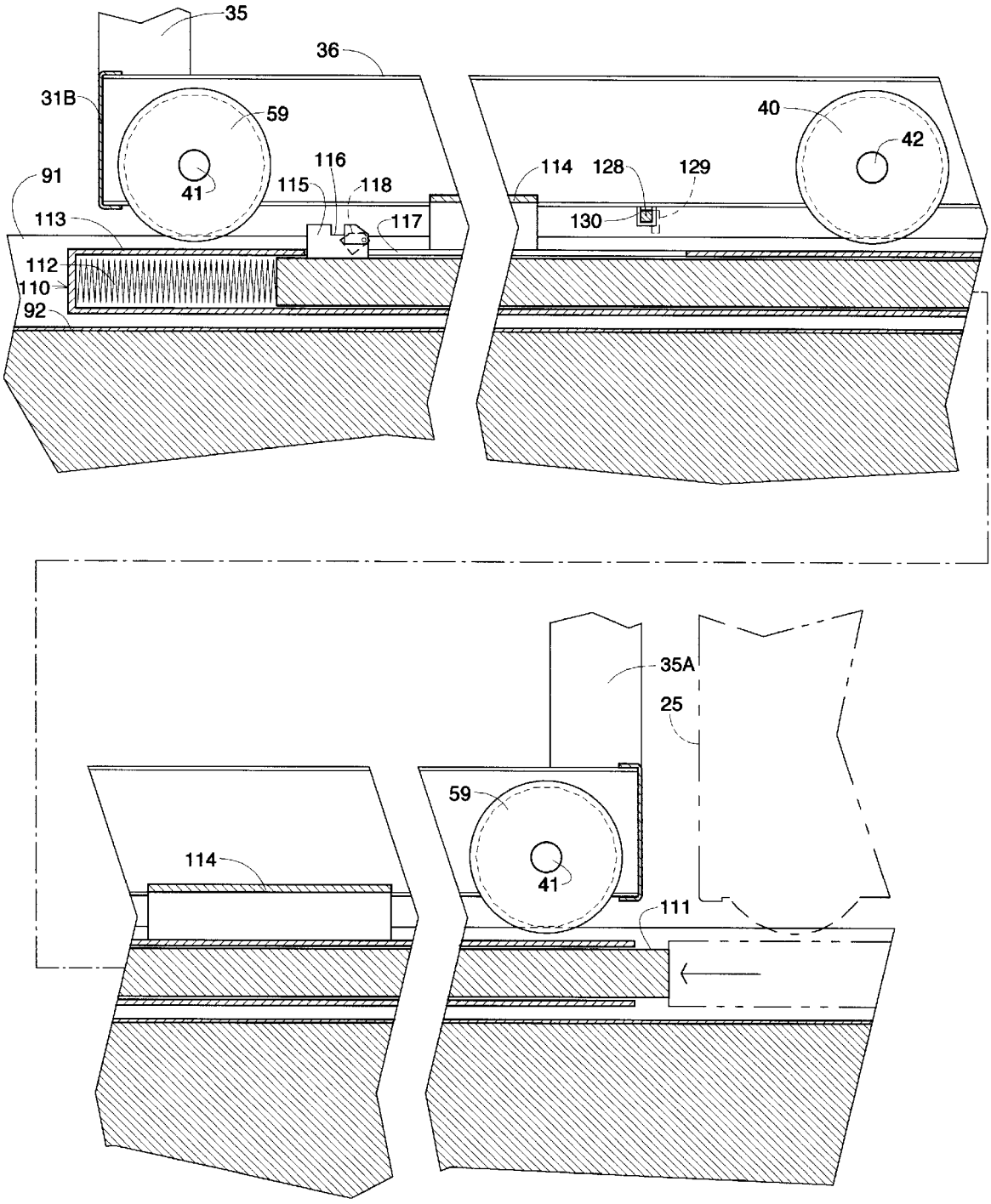
FIG. 13 shows a transverse section through a double-sided cabinet with the safety-spacer mechanism disengaged.

Rail 91 is positioned eccentrically within elongated rail enclosure 92 so as to provide clearance for an inscribed safety-spacer assembly (or elongated spacing means) 110 (which is shown in transverse section in FIG. 6 and in longitudinal section in FIGS. 8 and 9). This assembly is comprised of a spring-loaded projecting prod 111 affixed to a spring 112 mounted inside of an elongated hollow housing 113 which is attached to transverse joist 36A by means of an attachment bracket 114 (or other attachment means). When spring 112 is uncompressed projecting prod 111 extends out from elongated hollow housing 113. Likewise when spring 112 is compressed projecting prod 111 is largely contained within elongated hollow housing 113. A notched tab 115 is affixed to the top of projecting prod 111 and protrudes from elongated hollow housing 113 through a tab slot 117 (shown most clearly in FIGS. 9 and 11), which allows notched tab 115 with attached spring-loaded pawl 118 to move freely back and forth along with projecting prod 111. (FIGS. 12 and 13 show the identical operation of safety-spacer assembly 110 for double-sided cabinet 21, in which projecting prod 111 and elongated hollow housing 113 are longer than those shown for single-sided cabinet 20).

A notch 116 in notched tab 115 is positioned so as to receive a locking tab 129 that is affixed to a locking rod 128 which are included in a locking means or safety-spacer locking assembly 120 (shown in transverse section in FIGS. 8 and 9 and in elevation in FIGS. 6 and 7). Locking rod 128 is guided and supported by three guide collars (or pillow blocks) 130, affixed to the underside of chassis 30 (as shown in FIGS. 6 and 7). The end of locking rod 128 is connected to a releasing means or safety-spacer release assembly 133 by means of a transfer plate 127. Transfer plate 127 is pinned to a foot lever arm 121 that extends through side panel assembly 70 by means of a slot 131 to provide a support for a removable footpad 122 affixed to its extreme end. A guide 124 is affixed to secondary side enclosure support 73 in vertical alignment with a guide pin 123 affixed to foot lever arm 121. A spring 125 is affixed to secondary side enclosure support 73 in the vertical plane of foot lever arm 121 and in vertical alignment with guide pin 123. A guide arm 126 is pinned at one end to secondary side enclosure support 73 in vertical alignment with guide pin 123. The other end of guide arm 126 is pinned to foot lever arm 121 at a point along its length halfway between its pinned connection to transfer plate 127 and guide pin 123. The length of the distance between the two pins at either end of guide arm 126 is also equal to one half of the distance between the pinned connection of foot lever arm 121 to transfer plate 127 and the location of guide pin 123. The geometrical relationship of foot lever arm 121 and guide arm 126 is configured so as to allow a Scott Russell type straight-line motion to be imparted to transfer plate 127 and thence to locking rod 128.

Advantages

As will be evident from the above specification, the proposed invention shares many physical features with such mobile storage cabinets as are commonly used in libraries, offices, and the like. As it is a novel adaptation of the general idea of efficient storage embodied in those institutional cabinets to the problem of efficient use of activity-specific domestic space, however, certain fundamental enhancements and additions have been made and incorporated into the present invention. In particular, as this residential program deck is intended primarily for residential use and will thus be used more frequently, it proposes a novel safety-spacer that prevents occupants from being inadvertently crushed or trapped between adjacent cabinets by maintaining a minimum safe distance between any two adjacent cabinets while still allowing the cabinets to be moved. In addition, the present invention proposes a novel privacy partition that can be extended from any cabinet and attached to an adjacent cabinet, thereby enclosing a private space between any two adjacent cabinets. Moreover, the present invention describes a method for conveniently supplying power, data, and telephone to the cabinets. These and other novel additions and advantages will become clear in the description of the operational use of this residential program deck that follows.

Operation

The operation of the present invention is similar to the operation of such mobile storage cabinets in present use, in that the cabinets of the invention are movably relocated within a linear sequence of such cabinets so that adjacent cabinets can be brought into and out of abutting engagement with one another, thereby creating or eliminating a useful activity space 23 therebetween (shown in FIG. 1).

In the illustrated embodiment, movement is imparted to a cabinet by means of force-applying drive means (or driving means) 63, which includes rotatable handle assembly 44 (shown in detail in FIGS. 14A to 14D and FIGS. 15A and 15B). Handle grip assembly 52 is rotated out of handle grip recess 58 such that it is generally perpendicular to rotatable handle arm 48. Then rotatable handle arm 48 along with handle grip assembly 52 are pushed inward toward the cabinet along the axis of handle shaft extension 60. When handle arm sleeve 49 comes into contact with elongated salient projection 47, rotatable handle arm 48 may be rotationally adjusted until recessed socket 50 aligns with elongated salient projection 47, thereby allowing handle arm sleeve 49 to be pushed further into handle shaft collar 46 so that elongated salient projection 47 fits snugly into recessed socket 50. Thus the handle of the invention is now mechanically engaged with drive chain and gear assembly 43 and drive shaft 42 (shown in FIGS. 2 to 5) in order to comprise a force-applying drive means (or driving means) 63, allowing the rotation of rotatable handle arm 48 to impart movement to the cabinet of the invention in either direction along the length of elongated rail assemblies (or parallel linear guiding members) 90 and 90A.

When the user is finished moving a cabinet, handle grip assembly 52 may be rotated back into handle grip recess 58 in order to maintain a neat appearance and prevent the possibility of interference with or injury to passersby. Moreover, rotatable handle arm 48 may be disengaged from elongated salient projection 47 by pulling rotatable handle arm 48 away from the cabinet along the axis of handle shaft extension 60 until it is stopped by threaded end cap 51. This will allow rotatable handle arm 48 to hang loose about handle shaft extension 60 in the vertical orientation shown in FIG. 14B. Thus, if the cabinet under discussion is indirectly propelled by the movement of an adjacent cabinet, such movement will not be transferred to rotatable handle arm 48. This is advantageous, since the location of rotatable handle assembly 44 is near to the edge of the single-sided cabinets of the invention, such that if rotatable handle assembly 44 were left engaged, it is possible that any rotatable handle arm 48 might be indirectly driven so as to protrude beyond the edge of a cabinet, thus impeding access to a space between two adjacent cabinets.

In the mobile storage cabinets currently in use in libraries, offices, and the like it is incumbent upon the user to engage a lock in order to prevent the cabinets that they are accessing from being inadvertently closed upon them by other users. While it is possible that such users would forget to engage these locks, their occupation of the space between cabinets is typically of a short enough duration that they are in relatively little danger of being injured. Conversely, because of the anticipated residential use of the present invention, it is expected that users of the residential program deck will spend much more time occupying the space between cabinets since these are the spaces in which they will live. Moreover, at times they will occupy such spaces while asleep or otherwise distracted from the motion of the cabinets around them. Thus it is advantageous to the present invention to describe a means whereby a minimum safe distance between adjacent cabinets may be maintained while still allowing such cabinets to be moved as part of a larger chain of cabinets.

When a cabinet of the present invention is driven toward an adjacent cabinet, a safety-spacer assembly 110 (shown in FIG. 8) will prevent the cabinets from coming into immediate contact with one another. As seen in FIG. 8, projecting prod 111 will strike elongated hollow housing 113 of adjacent cabinet 25 (or, if moved in the opposite direction, elongated hollow housing 113 will strike the end of projecting prod 111 of the adjacent cabinet). The length of projecting prod 111 can be made such that it will maintain a minimum safe distance between adjacent cabinets when set in an extended position. Projecting prod 111 is locked into extended position by the insertion of locking tab 129 into notch 116 of notched tab 115, which is affixed to projecting prod 111 (shown also in elevation in FIGS. 6 and 7). Thus projecting prod 111 is able to maintain a minimum safe distance between adjacent cabinets while still allowing these adjacent cabinets and the space in between to be moved in unison. Moreover, as safety-spacer assembly 110 is concealed within the depth of elongated rail enclosure (or elongated linear enclosure) 92, it offers no additional obstruction to those users who would enter into or exit from this minimum safe space.

Figure 10:
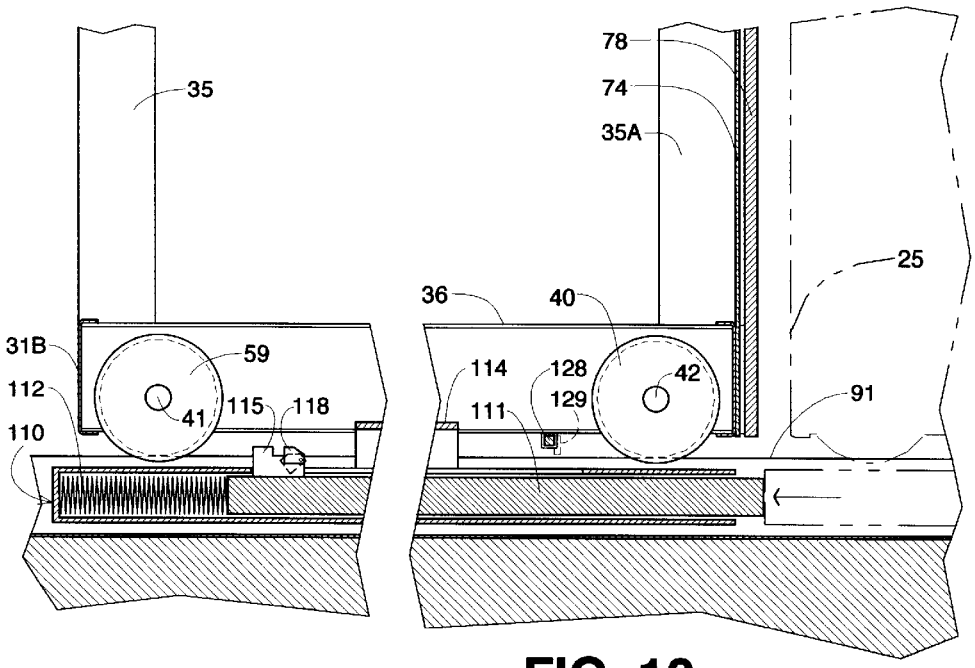
FIG. 10 shows a transverse section through a single-sided cabinet with the safety-spacer mechanism disengaged.

After ensuring that there are no occupants who would be trapped or injured between two such adjacent cabinets, it is possible to disengage safety-spacer assembly 110 such that this minimum safe space between cabinets can be eliminated. By depressing removable footpad 122 and foot lever arm 121 against spring 125 (shown in FIG. 6), a horizontal straight-line motion is imparted to transfer plate 127 and thus to locking rod 128, causing it to move toward the outside of the cabinet (as shown in FIG. 7). Locking tabs 129 (shown in FIG. 6), which are affixed to locking rod 128, are thus moved out of engagement with notched tabs 115 (shown in FIG. 7). This action unlocks projecting prods 111, allowing them to be driven against their springs 112 and thus into their respective elongated hollow housings 113, which allows the two cabinets in question to be brought into essentially contiguous contact (shown in FIGS. 10 and 13). The strength of springs 112 is not sufficient to overcome the friction caused by the static weight of the cabinet. Thus the two cabinets will remain in essentially contiguous contact until driven apart by the user.

When foot lever arm 121 is released spring 125 causes foot lever arm 121 to return to its initial position (shown in FIG. 6). This also causes transfer plate 127, locking rod 128, and locking tabs 129 to revert to their initial positions (shown also in FIG. 6).

As two contiguous cabinets are driven apart by the user, spring 112 pushes projecting prod 111 out from elongated hollow housing 113. As this occurs, spring-loaded pawl 118 is depressed by the underside of locking tab 129, thereby allowing the leading edge of notched tab 115 to pass by. When pawl 118 has cleared the underside of locking tab 129 its spring action returns it to an upright position, whereby it catches locking tab 129. Thus notched tab 115 along with projecting prod 111 are once again locked in their initial positions (shown in FIGS. 8 and 9).

Once the user has positioned the cabinets of the residential program deck as desired, it may then be further desired to enclose a space between two such cabinets in order to render it private. This is achieved by opening stowage area door 85 of the cabinet being used and drawing out extendable privacy partition 80 from privacy partition stowage area 84 (shown in overall view in FIG. 1 and as a plan section in FIGS. 16 and 17). Extendable privacy partition 80, illustrated here as an accordion-type partition, is then drawn across the space between two cabinets along privacy partition guide tracks 82 and 83 (shown in FIGS. 2 to 7) and affixed to the adjacent cabinet by a suitable attachment means (not shown).

Power, telephone, and data are supplied to each cabinet in the residential program deck by means of continuous conductor rail (or similar continuous linear electrical supply means) 100 set into the finished ceiling. Conductor heads 101 mounted to the top of each cabinet passively collect this power, telephone, and data and supply it by means of flexible conduit 103 to junction boxes 104, from which connections to the various infill packages can be made as required.

The appearance of each cabinet in the present invention can be easily changed or modified through the removal and replacement of removable decorative side panels 75 and 75A (shown in FIGS. 2 to 5). In order to remove decorative side panel 75 facing public access space 27 (shown in FIG. 1), removable footpad 122 is first removed from foot lever arm 121 (shown in FIG. 6). Thereafter, threaded end cap 51 (shown in FIG. 14D) is unscrewed from threaded end 62 of handle shaft extension 60, allowing rotatable handle arm 48 to be removed from handle shaft extension 60. At this point removable decorative side panel 75 may be freely pulled from steel side enclosure 71 (shown in FIGS. 2 to 5) by applying sufficient force to undo non-permanent fasteners 77 (such as hook-and-loop fasteners, snap fasteners, or the like). A new or modified removable decorative side panel 75 may then be affixed to steel side enclosure 71 by means of appropriate non-permanent fasteners 77. Removable decorative side panel 75A may be similarly removed from steel side enclosure 71A. Likewise, removable decorative back panel 78 on single-sided cabinet 20 (shown in FIGS. 2 and 3) may be similarly removed from steel back enclosure 74 and replaced.

CONCLUSION, RAMIFICATIONS, AND SCOPE

Accordingly, the reader will see that the residential program deck of the present invention provides a space-efficient and spatially-flexible alternative to the static, activity-specific, and space-wasting rooms of the traditional home. Moreover, the reader will see that the present invention provides an integral means for enclosing the open sides of the space created between any two of its constituent cabinets, that it provides a framework for accommodating multiple different types of furniture and fixture infill packages capable of supporting a variety of residential activities, that it provides cabinets that have chassis with integral inset areas that allow seated individuals facing these cabinets to comfortably use an inscribed desk or the like, that it provides cabinets with replaceable decorative side panels, that it provides a non-obstructing automatic safety-spacer mechanism that prevents two adjacent cabinets from inadvertently crushing or injuring an occupant and enables a minimum safe space to be maintained between adjacent cabinets while the cabinets are being moved, and that it provides a means for supplying power, telephone, and data to the cabinets.

While the above description contains many specificities, these should not be construed as limitations on the scope of the invention, but rather as an exemplification of one preferred embodiment thereof. Many other variations are possible. For example, public access spaces and extendable privacy panels may be disposed on both long sides of the residential program deck rather than just having the residential program deck adjacent to a continuous wall and accessible from only one long side. Additionally, the manual drive mechanism described above may be supplemented or replaced with an electrical drive system. Moreover, the invention may be applied to other types of frequently inhabited spaces in which the efficient use of occupied space and the elimination of unused space is desired, including, but not limited to, offices, medical examination rooms, and classrooms.

Thus the scope of the invention should be determined not by the embodiment illustrated, but by the appended claims and their legal equivalents.

I claim:

1. A residential program deck for dividing a dwelling into flexibly re-sizable particularized activity spaces, comprising:

(a) a plurality of horizontally-disposed parallel elongated rails;

(b) an elongated cabinet movably mounted on said parallel elongated rails;

(c) a continuous access space in parallel relation to said parallel elongated rails and outboard of a side of said cabinet in parallel relation to said parallel elongated rails;

(d) a force-applying drive means for moving said cabinet in either direction along said parallel elongated rails connected to said cabinet, said force-applying drive means accessible from said continuous access space;

(e) a partition movably mounted in parallel relation to said parallel elongated rails and in adjacent parallel relation to a side of said cabinet that faces said continuous access space, whereby said partition may be temporarily disposed to visually isolate a space between a side of said cabinet that is perpendicular to said parallel elongated rails and an adjacent parallel vertical surface from said access space.

2. The residential program deck of claim 1, further including a plurality of elongated cabinets movably mounted on said parallel elongated rails.

3. The residential program deck of claim 2, further including an end cabinet fixedly mounted at an end of said parallel elongated rails, said end cabinet including wet service attachment means for connecting wet services including hot and cold water supply, drainage, and sewage to said end cabinet, whereby said end cabinet may support such devices that require said wet services.

4. The residential program deck of claim 2, further including a continuous linear electrical supply means for conducting power, telephone, data and the like from outside sources to said cabinets disposed in parallel relation to said parallel elongated rails and a conduction means affixed to said cabinets for transference of said power, telephone, data and the like from said continuous linear electrical supply means to said cabinets.

5. The residential program deck of claim 2 wherein said force-applying drive means comprises:

(a) a plurality of pairs of wheels rollingly attached to said cabinet in rolling alignment with said parallel elongated rails, wherein a pair of said wheels is interconnected by an axle disposed in perpendicular relation to said parallel elongated rails;

(b) a rotatable drive means affixed to an end of said axle;

(c) a rotatable member rotatingly connected to said cabinet;

(d) a continuous chain means for mechanically connecting said rotatable drive means to said rotatable member;

(e) a rotatable shaft axially connected to said rotatable member and extending through said side of said cabinet that faces said continuous access space;

(f) a rotatable handle means for allowing a user to impart rotational movement to said rotatable shaft whereby a user can impart rotational movement to said rotatable member, thereby to said chain means, thereby to said rotatable drive means, thereby to said axle and said wheels, whereby the user may impart linear movement to said cabinet in either direction along said parallel elongated rails.

6. The residential program deck of claim 5 wherein said rotatable handle means comprises:

(a) an elongated salient projection attached to said rotatable shaft and oriented with its longitudinal direction in parallel relation to the longitudinal axis of said rotatable shaft, said elongated salient projection extending along said rotatable shaft a predetermined distance short of an end of said rotatable shaft that faces said continuous access space;

(b) a sleeve slidingly and rotatingly attached to the portion of said rotatable shaft that extends beyond an end of said elongated salient projection that faces said continuous access space, said sleeve containing a socket conforming to the shape of said elongated salient projection, whereby a user may rotate said sleeve about said rotatable shaft in order to bring said socket into alignment with said elongated salient projection, whereby said sleeve may be slid along the axis of said rotatable shaft toward said cabinet in order to bring said socket into interlocking relation with said elongated salient projection, whereby said sleeve may be mechanically engaged and disengaged with said rotatable shaft;

(c) a rotatable handle affixed to said sleeve, whereby said rotatable handle may be mechanically engaged and disengaged with said rotatable shaft.

7. The residential program deck of claim 2 wherein said parallel elongated rails each further include an elongated rail enclosure with a continuous slot penetrating the uppermost surface of said elongated rail enclosure, said elongated rail enclosure including clearance for an inscribed elongated spacing means for maintaining a predetermined minimum space between said cabinet and said adjacent cabinet, said elongated spacing means connected to an attachment means for suspending said elongated spacing means from the underside of said cabinet, said attachment means passing through said continuous slot in said elongated enclosure.

8. The residential program deck of claim 7 wherein said elongated spacing means comprises:

(a) an elongated hollow housing connected to said attachment means;

(b) a projecting prod slidingly inscribed within said elongated hollow housing and springably attached to a closed end of said elongated hollow housing, said projecting prod projecting outward from said elongated hollow housing through an open end of said elongated hollow housing in parallel relation to the longitudinal axis of said elongated rail enclosure, said projecting prod extending beyond the boundary of said cabinet by said predetermined minimum space;

(c) a locking means mounted to said underside of said cabinet and in engaging relation to said projecting prod, whereby said projecting prod may be locked into a position corresponding to said beyond the boundary of said cabinet by said predetermined minimum space;

(d) a releasing means for disengaging said locking means from said projecting prod affixed to said cabinet, whereby said projecting prod may be moved into said hollow housing, whereby said cabinet can be moved into contiguous relation to said adjacent cabinet.

9. A residential program deck of claim 2 wherein said cabinet further includes a removable decorative panel detachably affixed with non-permanent fasteners to said side of said cabinet that faces said continuous access space.

10. A residential program deck of claim 2 wherein said cabinet further includes a chassis comprised of a plurality of interconnected transversely disposed members and longitudinally disposed members, wherein a side of said chassis that is parallel with said side of said cabinet that is perpendicular to said parallel elongated rails includes an inscribed area of sufficient size to accommodate the feet of an individual seated at and facing said side of said cabinet that is perpendicular to said parallel elongated rails.

11. A residential program deck for dividing a dwelling into flexibly re-sizable particularized activity spaces, comprising:

(a) a plurality of horizontally-disposed parallel linear guiding members;

(b) an elongated cabinet movably mounted on said parallel linear guiding members;

(c) a continuous access space in parallel relation to said parallel linear guiding members and outboard of a side of said cabinet in parallel relation to said parallel linear guiding members;

(d) an extendable partition movably mounted in parallel relation to said parallel linear guiding members, one vertical edge of said extendable partition affixed to said cabinet in adjacent parallel relation to a side of said cabinet that faces said continuous access space, whereby said partition may be extended out from said cabinet and temporarily disposed to visually isolate a space between a side of said cabinet that is perpendicular to said parallel linear guiding members and an adjacent parallel vertical surface from said access space.

12. The residential program deck of claim 11, further including a plurality of elongated cabinets movably mounted on said parallel linear guiding members.

13. The residential program deck of claim 12, further including an end cabinet fixedly mounted at an end of said parallel linear guiding members, said end cabinet including wet service attachment means for connecting wet services including hot and cold water supply, drainage, and sewage to said end cabinet, whereby said end cabinet may support such devices that require said wet services.

14. The residential program deck of claim 12, further including a continuous linear electrical supply means for conducting power, telephone, data and the like from outside sources to said cabinets disposed in parallel relation to said parallel linear guiding members and a conduction means affixed to said cabinets for transference of said power, telephone, data and the like from said continuous linear electrical supply means to said cabinets.

15. The residential program deck of claim 12, further including a driving means for moving said cabinet in either direction along said parallel linear guiding members, comprising:

(a) a plurality of pairs of wheels rollingly attached to said cabinet in rolling alignment with said parallel linear guiding members, wherein a pair of said wheels is interconnected by an axle disposed in perpendicular relation to said parallel linear guiding members;

(b) a rotatable drive means affixed to an end of said axle;

(c) a rotatable member rotatingly connected to said cabinet;

(d) a continuous chain means for mechanically connecting said rotatable drive means to said rotatable member;

(e) a rotatable shaft axially connected to said rotatable member and extending through said side of said cabinet that faces said continuous access space;

a rotatable handle means for allowing a user to impart rotational movement to said rotatable shaft connected to said rotatable shaft, whereby a user can impart rotational movement to said rotatable member, thereby to said chain means, thereby to said rotatable drive means, thereby to said axle and said wheels, whereby the user may impart linear movement to said cabinet in either direction along said parallel linear guiding members.

16. The residential program deck of claim 15 wherein said rotatable handle means comprises:

(a) an elongated salient projection attached to said rotatable shaft and oriented with its longitudinal direction in parallel relation to the longitudinal axis of said rotatable shaft, said elongated salient projection extending along said rotatable shaft a predetermined distance short of an end of said rotatable shaft that faces said continuous access space;

(b) a sleeve slidingly and rotatingly attached to the portion of said rotatable shaft that extends beyond an end of said elongated salient projection that faces said continuous access space, said sleeve containing a socket conforming to the shape of said elongated salient projection, whereby a user may rotate said sleeve about said rotatable shaft in order to bring said socket into alignment with said elongated salient projection, whereby said sleeve may be slid along the axis of said rotatable shaft toward said cabinet in order to bring said socket into interlocking relation with said elongated salient projection, whereby said sleeve may be mechanically engaged and disengaged with said rotatable shaft;

(c) a rotatable handle affixed to said sleeve, whereby said rotatable handle may be mechanically engaged and disengaged with said rotatable shaft.

17. The residential program deck of claim 12 wherein said parallel linear guiding members each further include an elongated linear enclosure with a continuous slot penetrating the uppermost surface of said elongated linear enclosure, said elongated linear enclosure including clearance for an inscribed elongated spacing means for maintaining a predetermined minimum space between said cabinet and said adjacent cabinet, said elongated spacing means connected to an attachment means for suspending said elongated spacing means from the underside of said cabinet, said attachment means passing through said continuous slot in said elongated linear enclosure.

18. The residential program deck of claim 17 wherein said elongated spacing means comprises:

(a) an elongated hollow housing connected to said attachment means;

(b) a projecting prod slidingly inscribed within said elongated hollow housing and springably attached to a closed end of said elongated hollow housing, said projecting prod projecting outward from said elongated hollow housing through an open end of said elongated hollow housing in parallel relation to the longitudinal axis of said elongated linear enclosure, said projecting prod extending beyond the boundary of said cabinet by said predetermined minimum space;

(c) a locking means mounted to said underside of said cabinet and in engaging relation to said projecting prod, whereby said projecting prod may be locked into a position corresponding to said beyond the boundary of said cabinet by said predetermined minimum space;

(d) a releasing means for disengaging said locking means from said projecting prod affixed to said cabinet, whereby said projecting prod may be moved into said hollow housing, whereby said cabinet can be moved into contiguous relation to said adjacent cabinet.

19. A residential program deck of claim 12 wherein said cabinet further includes a removable decorative panel detachably affixed with non-permanent fasteners to said side of said cabinet that faces said continuous access space.

20. A residential program deck of claim 12 wherein said cabinet further includes a chassis comprised of a plurality of interconnected transversely disposed members and longitudinally disposed members, wherein a side of said chassis that is parallel with said side of said cabinet that is perpendicular to said parallel linear guiding members includes an inscribed area of sufficient size to accommodate the feet of an individual seated at and facing said side of said cabinet that is perpendicular to said parallel linear guiding members.

* * * * *